US006698435B2

(12) United States Patent
Miller

(10) Patent No.: US 6,698,435 B2
(45) Date of Patent: Mar. 2, 2004

(54) FOLDING SMOKING PIPE

(75) Inventor: Kenneth C. Miller, Aptos, CA (US)

(73) Assignee: FAB-HK Limited, Hong Kong ( * ) Notice: Subject to any disclaimer, the term of this patent is extended or adjusted under 35 U.S.C. 154(b) by 0 days.

(21) Appl. No.: 09/964,051

(22) Filed: Sep. 26, 2001

(65) Prior Publication Data

US 2003/0178035 A1 Sep. 25, 2003

Related U.S. Application Data

(60) Provisional application No. 60/258,803, filed on Dec. 29, 2000.

(51) Int. Cl.[7] ..... A24F 7/02

(52) U.S. Cl. ..... 131/192; 131/196; 131/330; 206/244; 206/273; 206/271

(58) Field of Search ..... 131/192, 194, 131/196, 330, 174, 199, 220, 230; 206/244, 271, 273; D27/163

(56) References Cited

U.S. PATENT DOCUMENTS

| | | | |
|---|---|---|---|
| 3,902,505 | A | 9/1975 | Carleton |
| 4,058,130 | A | 11/1977 | Curtiss |
| 5,850,838 | A | 12/1998 | Sigrist |

*Primary Examiner*—Dionne A. Walls
(74) *Attorney, Agent, or Firm*—Donald R. Boys; Central Coast Patent Agency, Inc.

(57) ABSTRACT

A foldable smoking pipe is constructed from a flat blank of metal, small enough to fit in a wallet, that can be folded into a functional smoking pipe with an integrated bowl, screen, and stem. The stem is formed by multiple flat panels folded to create a passageway having an opening at one end. The stem has an upper panel with holes in it to form the screen. The bowl is formed by multiple flat panels folded to surround the screen. The flat blank of metal has a number of fold lines, which preferably are etched to about one-half the thickness of the metal blank, joining adjacent panels.

15 Claims, 10 Drawing Sheets

FOLDING SMOKING PIPE

This application claims priority from co-pending provisional application No. 60/258,803, filed Dec. 29, 2000.

FIELD OF THE INVENTION

This invention relates generally to pipes used for smoking tobacco, and relates more particularly to a pipe made from a flat sheet of material that can be folded into a functional shape.

BACKGROUND OF THE INVENTION

A typical smoking pipe has a bowl joined to a stem. The bowl holds the tobacco or other smoking material and has an air passageway at the bottom that connects to the stem. The stem is a tubular structure having a bit opposite the bowl through which a user draws smoke. The tobacco and the ash that results from burning are typically isolated from the stem by a screen or narrow region or baffle in the air passageway. Repeated use of the pipe causes tars and other residue to build up in the bowl, on the screen and in the stem, which may interfere with the taste and pleasure of the smoke and which may build up enough to interfere with the function of the pipe. Cleaning the pipe reduces but may not eliminate all the tars and residue. Discarding the pipe after several uses and using a new, clean pipe is one solution to this problem, but can be expensive. Thus, there is a need for an inexpensive pipe that may be used once or a few times and then discarded.

U.S. Pat. No. 4,058,130 discloses a disposable pipe that is formed by folding a T-shaped single sheet of flexible material into a functional pipe with a stem and bowl. The sheet has several interconnected panels, made of paper, that are folded and formed into a stem, with overlapping panels that are fastened together with glue. The sheet also has several interconnected panels, made of paper lined with fire proof material like aluminum foil, that are folded to form a bowl, with overlapping panels that are fastened together with glue. Inside the stem is a filter that extends from near the bowl to the bit end of the pipe. This pipe is disposable and is intended to be distributed in its assembled form, with or without tobacco.

Another concern about traditional smoking pipes is their size and bulk. A traditional pipe is a three-dimensional object that occupies a substantial space, which may be too bulky to carry conveniently in a pocket or small bag. The bulk of traditional smoking pipes, or a pipe like that disclosed in U.S. Pat. No. 4,058,130, makes retailing more expensive, which makes them less available than they might be if they were less bulky to stock and distribute.

U.S. Pat. No. 3,902,505 discloses a disposable pipe formed from a foldable flat blank, made of paper or plastic, with a collapsed metal foil bowl. The body of the pipe is made by folding the panels of the flat blank and using tabs coated with adhesive to hold the structure together. The bowl is initially installed in a flattened condition, and can be unfolded into a bowl shape. The bottom of the bowl is perforated to allow smoke to be drawn into the body of the pipe. Although this pipe in its flat form prior to assembly is less bulky than traditional pipes, the flattened bowl adds substantially to the thickness of the pipe and to the cost of construction.

What is needed is a less-bulky and less-expensive disposable smoking pipe that would be convenient for a smoker to carry and convenient for a retailer to stock.

SUMMARY OF THE INVENTION

In summary, the present invention is a smoking pipe constructed from a flat sheet of material, small enough to fit in a wallet, which can be folded into a functional smoking pipe with an integrated bowl, screen, and stem. The stem is formed by multiple flat panels folded to create a passageway having an opening at one end. The screen consists of several holes through an upper panel of the stem. The bowl is formed by multiple flat panels folded to surround the screen. The material of the smoking pipe is preferably metal, formed into a flat blank ready for folding. The blank of metal has a number of reduced thickness fold lines, which preferably are about one-half the thickness of the metal blank, that join adjacent panels and permit the panels to be folded.

The present invention is also a foldable blank that can be assembled into a functional smoking pipe. The foldable blank is a flat sheet of material, preferably metal, composed of stem panels and bowl panels. The sheet of metal has fold lines between adjacent panels that allow adjacent stem panels to be bent along the fold lines to form a hollow stem of the smoking pipe. The fold lines also allow adjacent bowl panels to be bent along the fold lines to form a bowl of the smoking pipe. One stem panel has holes that form a perforated screen disposed between the bowl and hollow stem of the smoking pipe.

The foldable blank of the present invention is inexpensive to manufacture and small in size, so it is easy to transport and store. It is convenient for a smoker to carry in a wallet and convenient for a retailer to stock. When the smoker wants to use the pipe, the foldable blank is folded along the fold lines into a functional pipe.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENTS

The drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
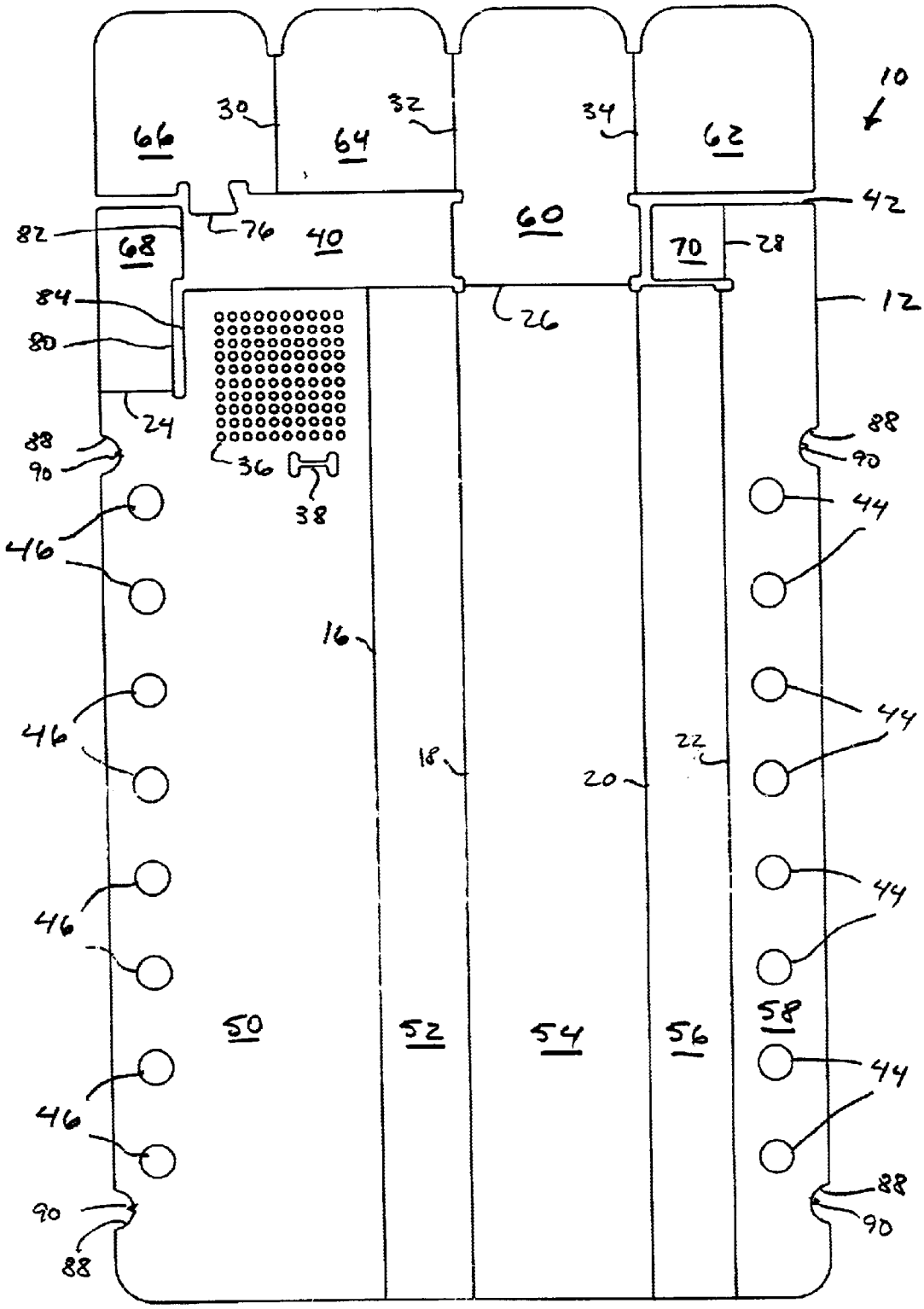
FIG. 1 is a plan view of a smoking pipe according to the present invention in a flat condition prior to assembly into a functional shape.

As shown in FIGS. 1–10, the smoking pipe 10 of the present invention is fabricated from a unitary, flat sheet of material, which is preferably a metal such as stainless steel, brass, or copper having a thickness of about 0.010 inch. The pipe 10 is shown in FIG. 1 in a flat condition as a blank 12 prior to assembly, and is shown as assembled into a functional shape 14 in FIGS. 2–10.

The pipe blank 12 is preferably made by photo-chemical machining using photomasks and photoresist on both sides of a sheet of material to define areas to be exposed to an etchant. The etching process is controlled so that the etchant dissolves at least one-half of the thickness of the material that is exposed. Wherever the photomasks expose the material to the etchant on both sides, the etchant will etch all the way through both sides of the material to create a hole or edge. Wherever the photomasks expose the material to the etchant on only one side, the etchant will etch only half way through to form a weakened area for a fold line. Wherever the photomasks cover both sides of the material, no etching occurs.

As shown in FIG. 1, the flat pipe blank 12 has several fold lines 16, 18, 20, 22, 24, 26, 28, 30, 32, and 34 that have been formed by etching halfway through the thickness of the material as described above, or by an equivalent means. Folds 22 and 24 are preferably formed on the underside of the blank 12 (as shown in FIG. 1) and the remaining folds are formed on the top side of the blank (as shown in FIG. 1). Adjacent panels can be bent at the fold lines to form the assembled pipe 14. The assembly of the pipe is explained in more detail below.

In addition to the fold lines, the flat pipe blank 12 also has several void areas where the material has been completely removed by etching from both sides, including a grid of holes 36, slot 38, void area 40, relief 42, and decorative holes 44 and 46. FIG. 1 also shows that the flat pipe blank 12 has five stem panels 50, 52, 54, 56, and 58 that are used to form a rectangular stem of the assembled pipe 14, four bowl panels 60, 62, 64, and 66 that are used to form a rectangular bowl of the assembled pipe, and two support panels 68 and 70 that are used to support the bowl of the assembled pipe.

The fold lines permit the pipe sections to be folded into the assembled pipe 14, which is shown in FIGS. 2–10. Generally speaking, the pipe 14 is assembled by folding adjacent panels at the fold lines to 90 degrees. Preferably, the panels are folded so that the etched line is on the outside of the fold, although the panels can be folded so that the etched line is on the inside of the fold provided that enough material is etched away to permit such a fold.

Stem panels 50, 52, 54, 56, and 58 are folded into a rectangular box shape to form a stem 72 of the assembled pipe 36. Each fold line allows the panels to be folded with respect to each other at about a right angle. The stem 72 is a hollow box, open at one end and extending to the grid of holes 36 at the other end. The open end of the stem serves as the bit of the pipe. Panel 58 overlaps panel 50 so that the decorative holes 44 and 46 line up. The metal is malleable, so the folds are stable and do not flatten out after forming. No adhesive or glue is needed for the assembled pipe to retain its shape.

Figure 2:
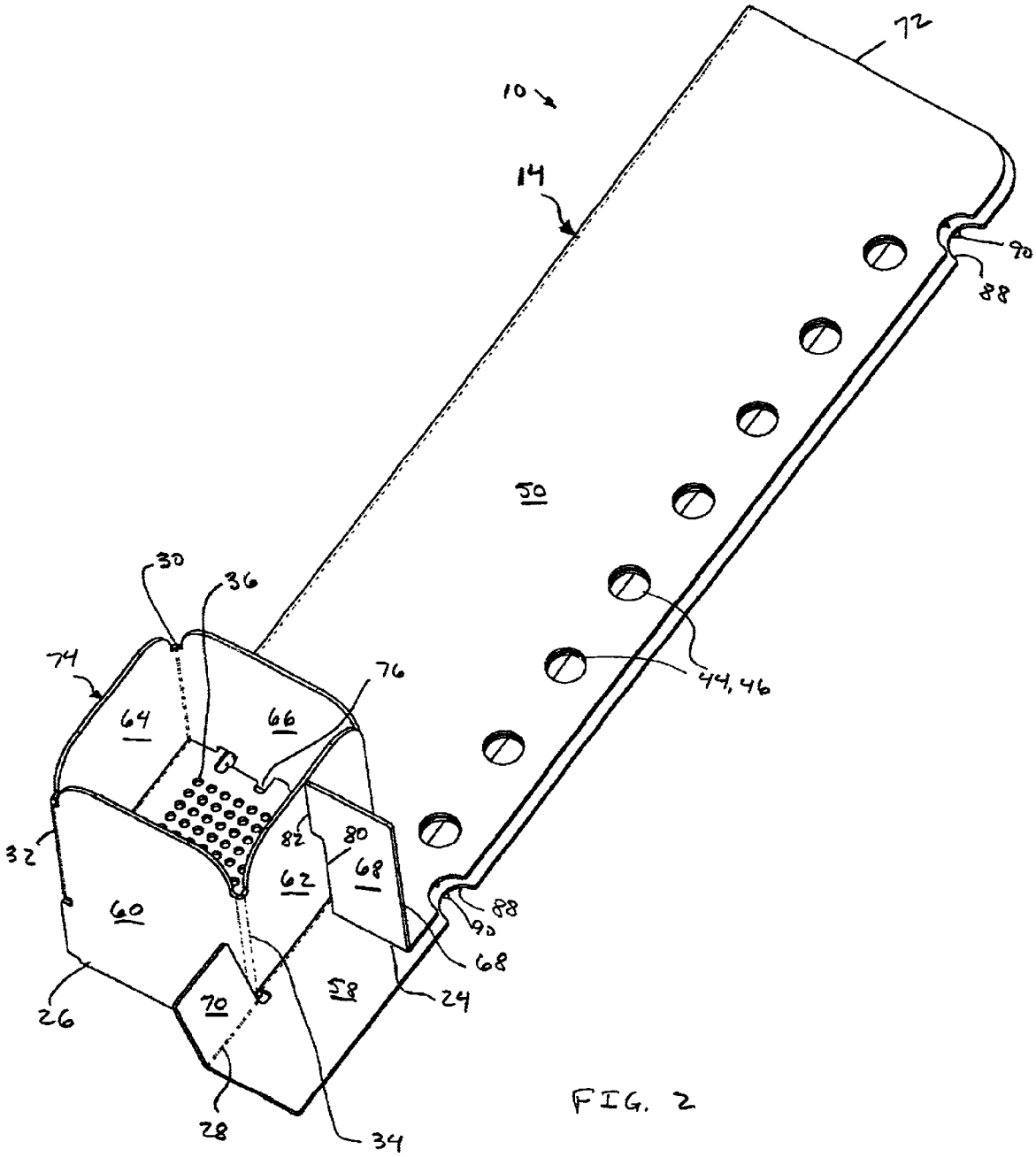
FIG. 2 is a perspective view of the rear of the smoking pipe of the present invention as assembled into a functional shape.
Figure 3:
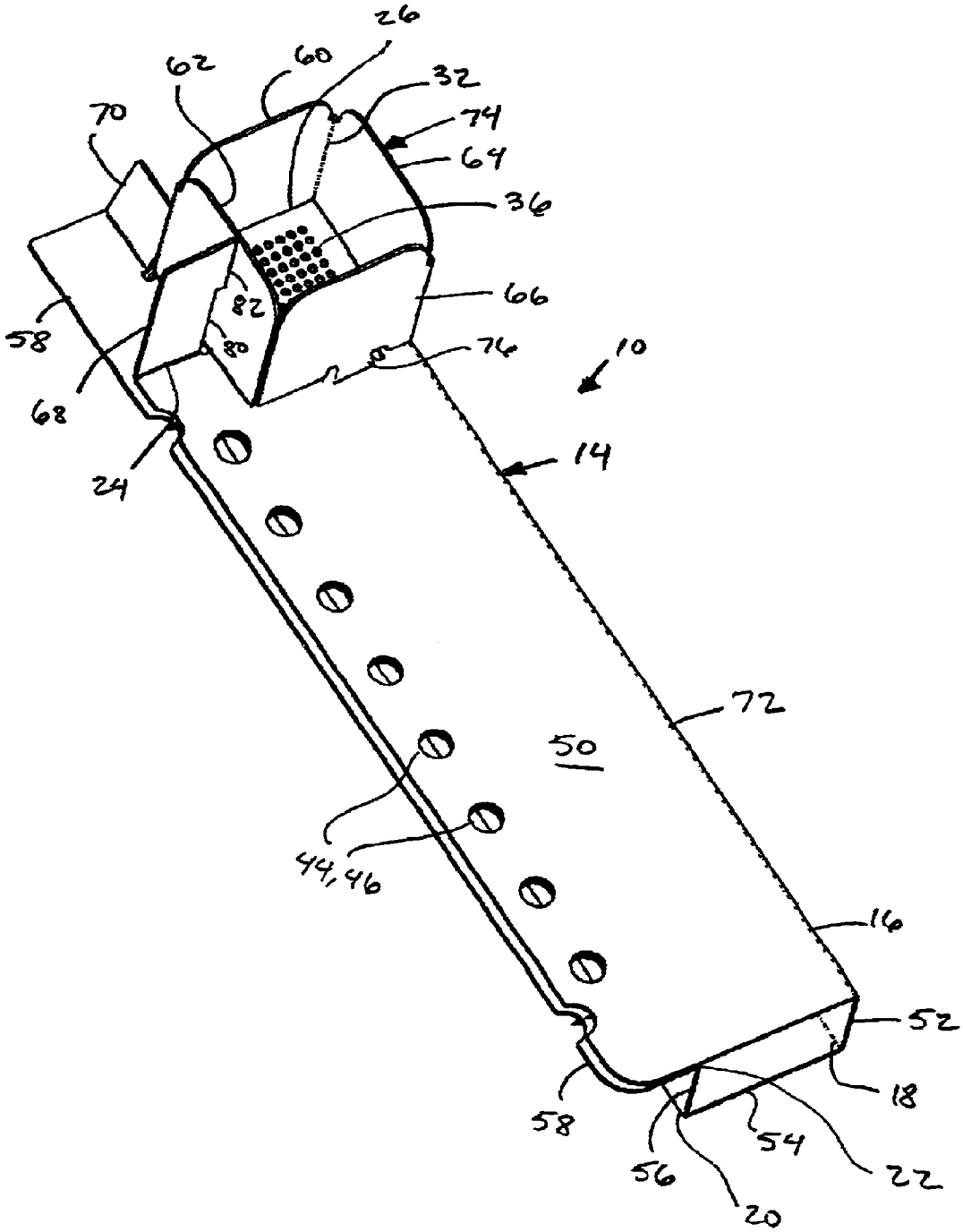
FIG. 3 is a second perspective view of the front of the smoking pipe of the present invention as assembled into a functional shape.
Figure 4:
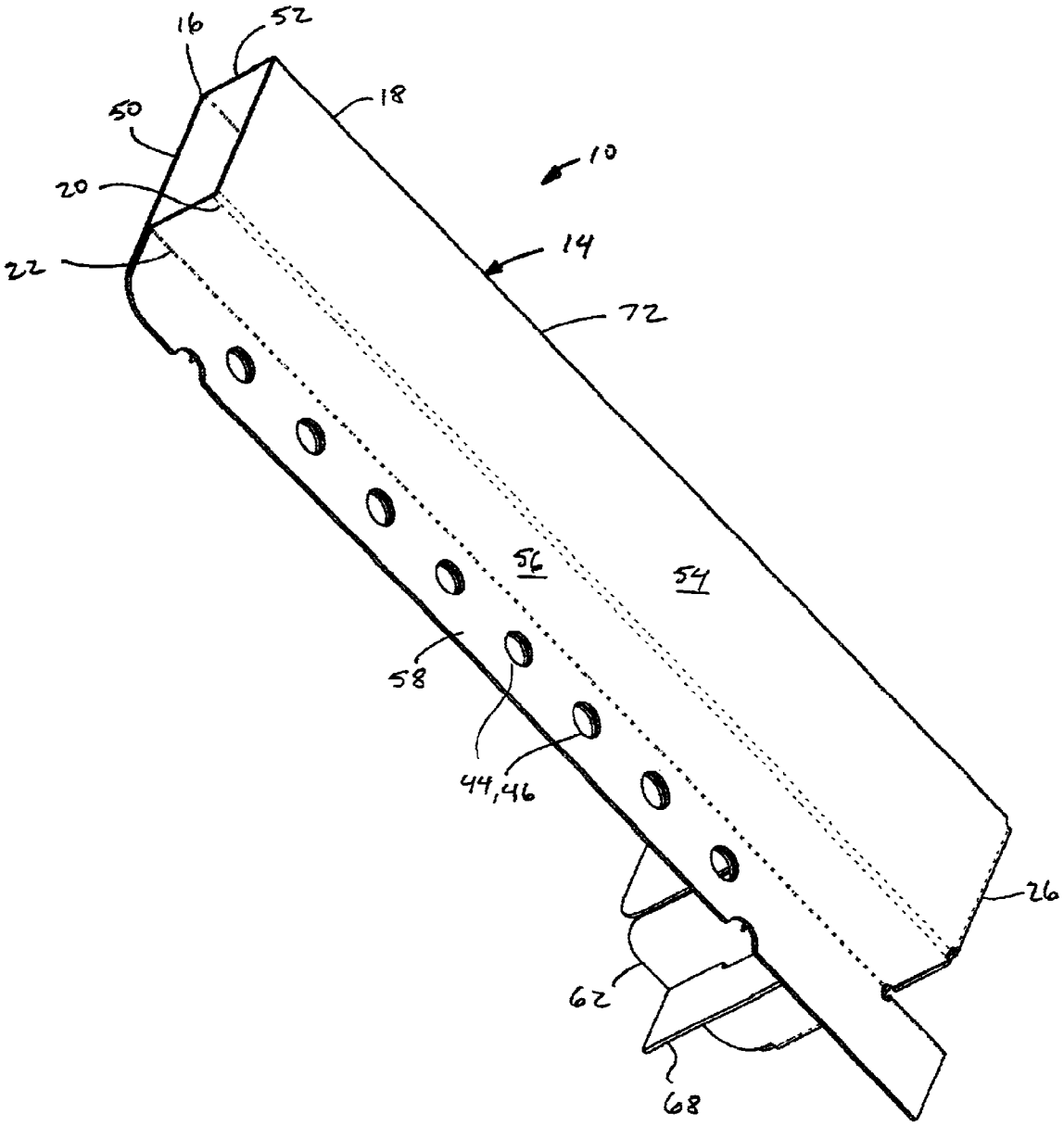
FIG. 4 is a third perspective view of the underside of the smoking pipe of the present invention as assembled into a functional shape.
Figure 5:
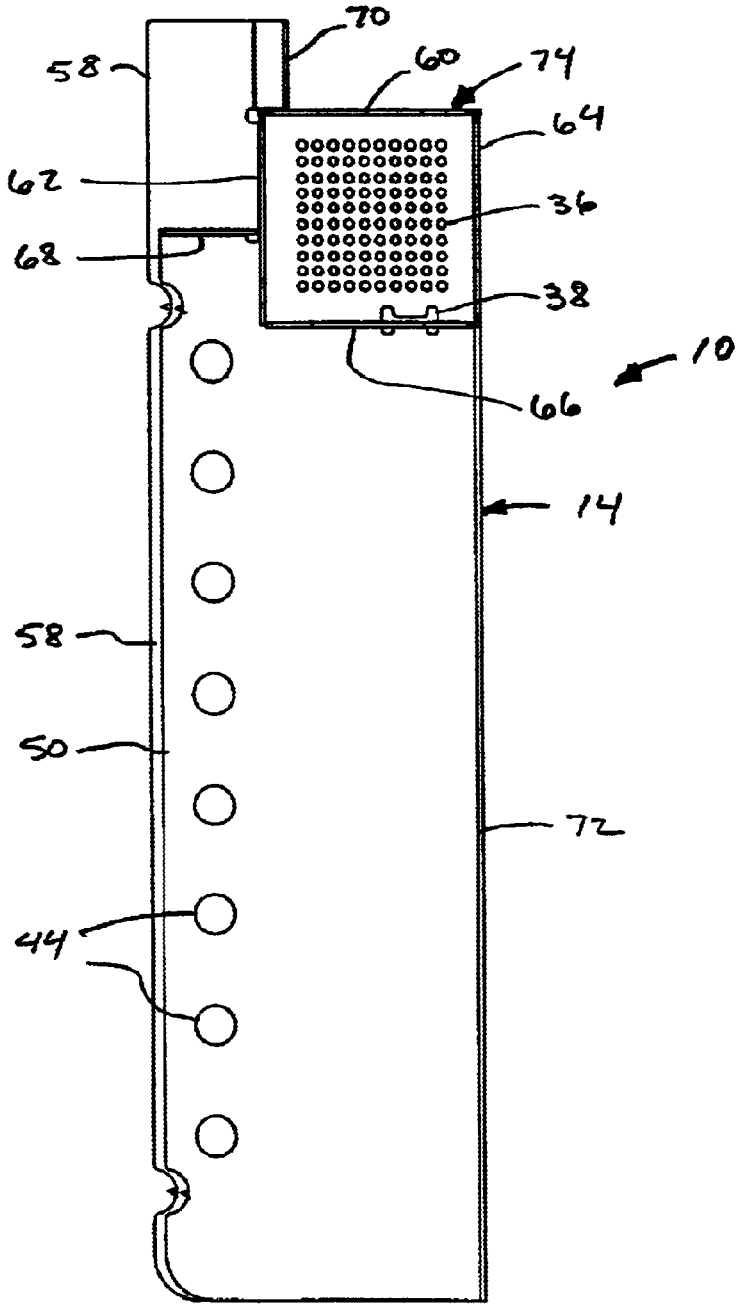
FIG. 5 is a top view of the smoking pipe of the present invention as assembled.
Figure 6:
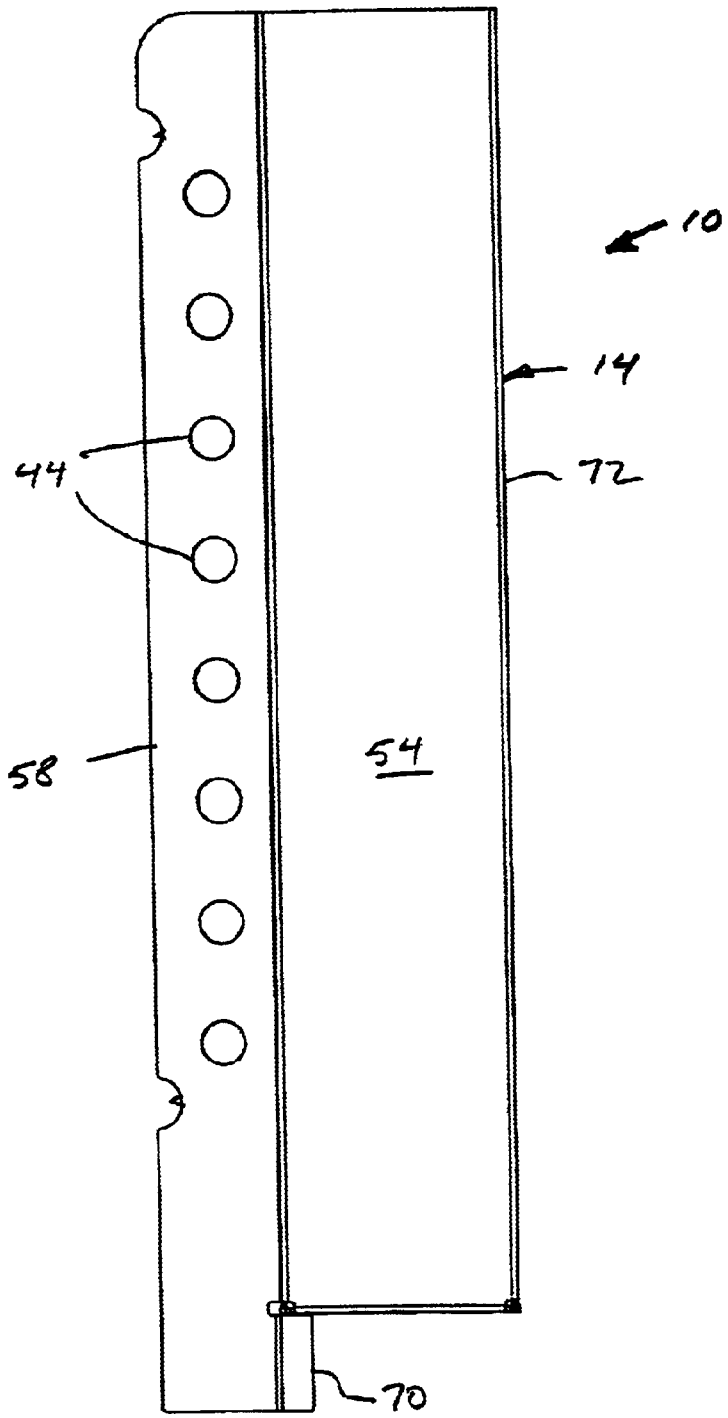
FIG. 6 is a bottom view of the smoking pipe of the present invention as assembled.
Figure 7:
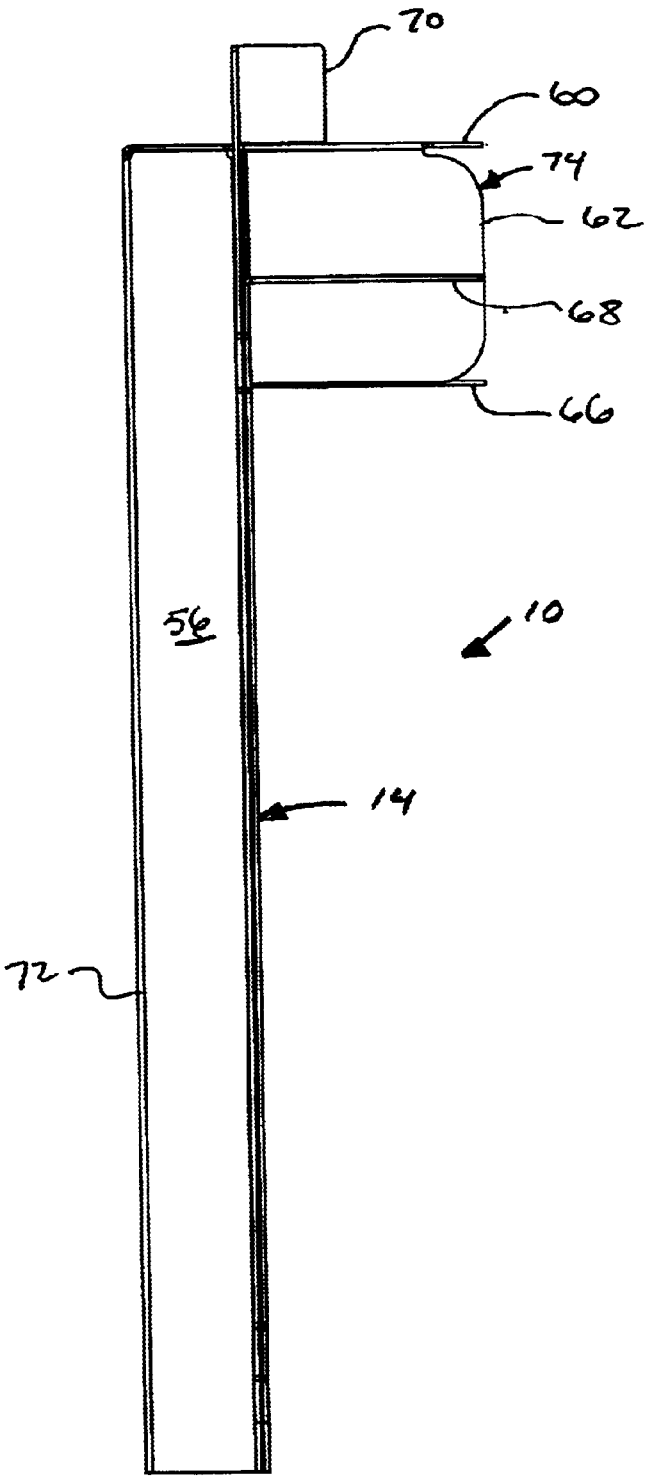
FIG. 7 is a left side view of the smoking pipe of the present invention as assembled.
Figure 8:
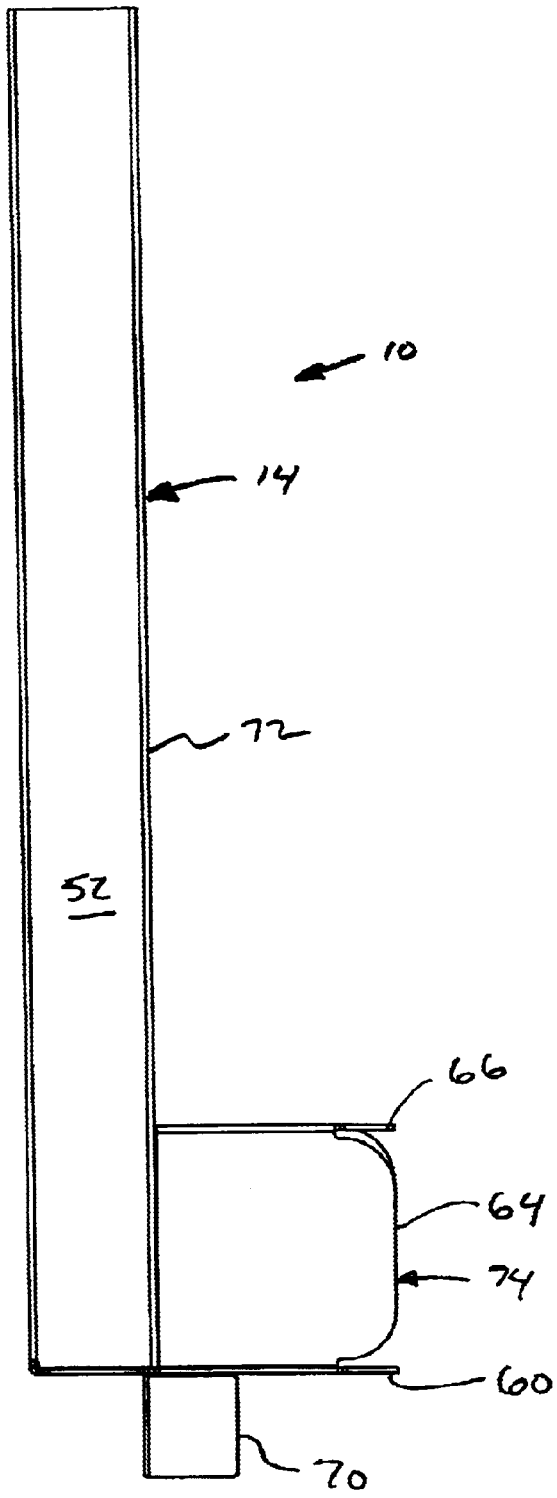
FIG. 8 is a right side view of the smoking pipe of the present invention as assembled.
Figure 9:
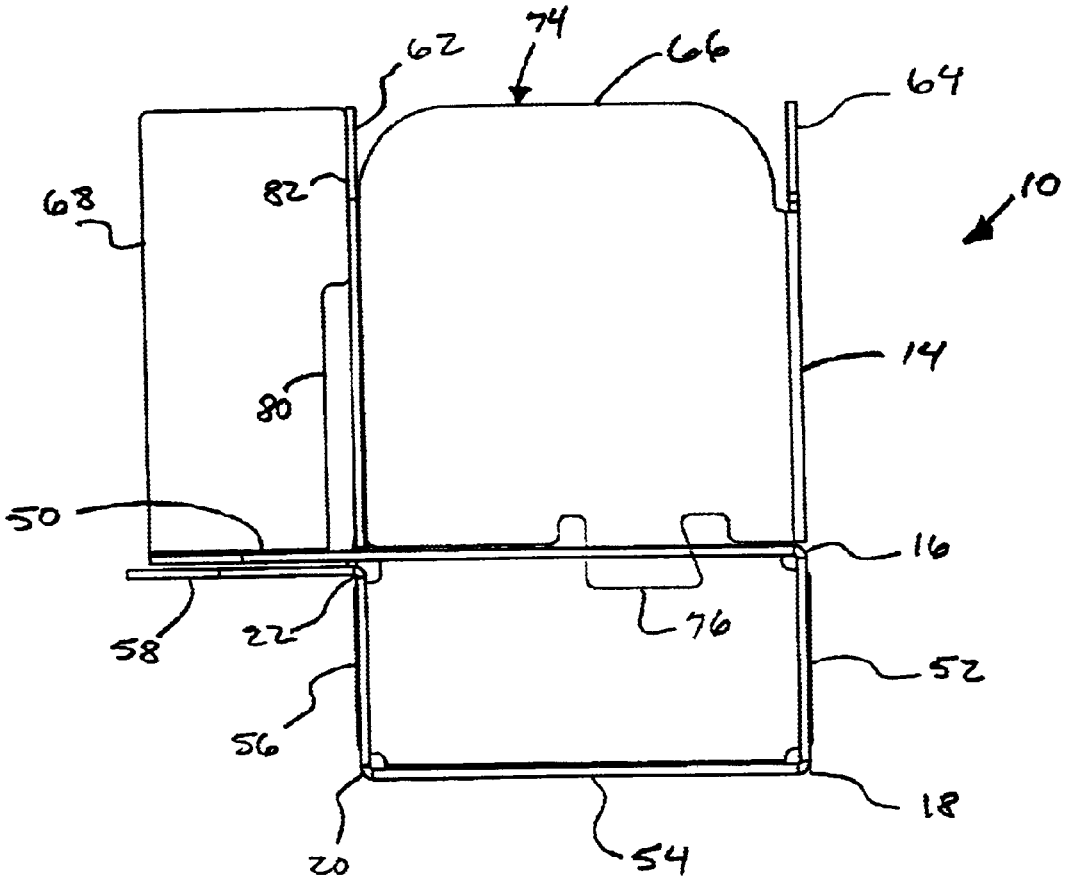
FIG. 9 is a front elevation view of the smoking pipe of the present invention as assembled.
Figure 10:
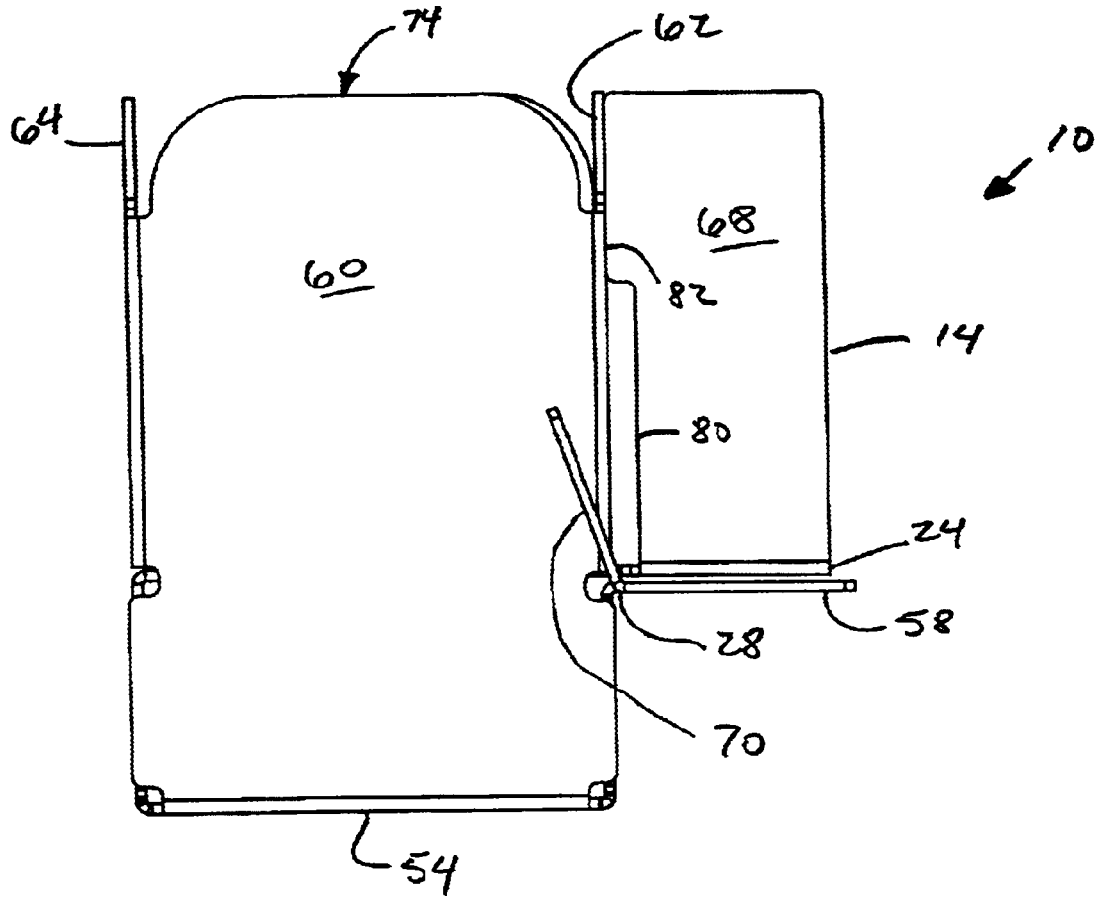
FIG. 10 is a rear elevation view of the smoking pipe of the present invention as assembled.

As shown best in FIGS. 2 and 3, the assembled pipe 14 has a bowl 74 positioned above and surrounding the grid of holes 36. Bowl panel 60 is attached to stem panel 54 at fold line 26, and is folded up to form a backside of the bowl 74 and also to close off the distal end of the hollow box of the stem 72. Bowl panel 60 is retained by support panel 70, which is bent up relative to stem panel 58, but at an oblique angle (not a right angle). Bowl panel 62 is attached by fold line 34 to one side of bowl panel 60 and is folded to form another side of the bowl 74. Support panel 68, which is attached to stem panel 50 at fold line 24, is folded up about 90 degrees to hold bowl panel 62 in position. Bowl panel 64 is attached by fold line 32 to the other side of bowl panel 60 and is folded to form another side of the bowl 74. Bowl panel 66 is attached to bowl panel 64 at fold line 30 and is folded to form a front side of the bowl 74. There is a tab 76 extending from a lower edge of panel 66, which is inserted into slot 38 in stem panel 50 to help orient and retain bowl panel 66.

The panels can be folded in a number of equivalent sequences to form the assembled pipe 14. If the stem is formed first, by folding the stem panels at fold lines 16, 18, 20, and 22, the support panel 70 will need to be folded out of the way to provide clearance for the bowl panel 60 to be folded at fold line 26. After the bowl panel 60 is folded, the support panel 70 can be folded back to the position shown in the figures.

When the pipe is assembled into its functional shape 14, the lower edges of the bowl panels 62, 64, and 66 rest on the upper surface of the stem panel 50, and, along with bowl panel 60, surround the grid of holes 36 to form the bowl 74. The grid of holes 36 is a perforated screen that separates the bowl from the stem, but provides a flow passage through the bowl into the interior of the stem.

As shown in FIGS. 1, 2, 3, 9, and 10, support panel 68 has an irregular shape facing the bowl panel 62. A lower edge 80 of the support panel 68 is relieved outward relative to the bowl panel 62, while an upper edge 82 of the panel 68 contacts the panel 62. This edge shape in effect shifts the slot 84 between panel 68 and panel 50 outward to close off a gap that would otherwise exist at the bottom of the bowl 74 at the lower edge of bowl panel 62.

The flat pipe blank 12 is preferably fabricated in large sheets containing many blanks to be processed simultaneously. A large sheet of material is photomasked on both sides with multiple, repeated patterns to define the areas to be masked or exposed to the etchant. In order to conveniently handle the multiple blanks, it is preferred to keep them joined together using a frame (not shown) until the etching is complete and then separate them. Small tabs, formed by photo-chemical machining, extend from the sides of the blanks and join them to the frame until they are separated. If the edges of the blanks were straight, then the tabs once broken apart would leave rough spots on the edges. The rough spots could be machined off or otherwise removed, but that is an extra processing step that would increase cost. To avoid post-separation machining, the pipe blanks 12 have recessed areas 88 where the interconnecting tabs 90 are located, as shown in FIG. 1. Even though the tabs 90 remain after the blanks are separated, they are recessed relative to the edges.

The flat pipe blank 12 is preferably the size of a plastic credit card or less. Dimensions of 1.900 inches by 3.400 inches have been found to be acceptable. With such a small size, and a thickness of about 0.010 inches, the flat pipe is quite small and easy to store or transport. It can be carried with credit cards in a wallet. When needed for use, the pipe can be assembled without tools merely by folding along the fold lines. The small, compact size of the flat pipe of the present invention lends itself to many retail options, including vending machines or counter sales. The flat pipe can easily be packaged with tobacco or other smoking materials as a bonus or premium feature.

The flat pipe blank 12 can be labeled with information, such as assembly instructions, trademarks, logos, advertisements, contact information, or decorative art. To do so, the surface of the flat pipe blank can be etched during the photo-chemical machining. Alternatively, paint, ink, or dyes can be applied to the surface of the flat pipe blank by post etching silkscreening or similar process.

Photo-chemical machining is the preferred method of making the flat pipe blank from a sheet of metal. Alternatively, the flat pipe blank can be made by stamping, perhaps using a progressive die, to form the edge cuts, holes, and fold lines. Another method is laser cutting, using a laser beam to cut through the material at the edge cuts and holes, and to remove about half the thickness of material at the fold lines. Still another method is machining with metal-cutting tools.

From the above description, it will be apparent that the invention disclosed herein provides a novel and advantageous smoking pipe. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A smoking pipe comprising:

an elongated hollow stem formed of multiple flat panels enclosing a passageway having an opening at one end, the stem having an upper panel;

a perforated screen integral to the upper panel of the stem at an end opposite the opening, wherein the screen is open to the passageway of the stem; and a bowl formed of multiple flat panels surrounding the perforated screen;

wherein the pipe is constructed by folding a unitary, flat blank of metal, and wherein each panel is joined to at least one other adjacent panel by fold lines formed in the blank.

2. A smoking pipe as recited in claim 1 wherein the fold lines are scored areas of the flat blank of metal that facilitate folding of adjacent panels.

3. A smoking pipe as recited in claim 2 wherein the scored areas are areas of reduced thickness of the flat blank of metal.

4. A smoking pipe as recited in claim 2 wherein the scored areas are formed by photo-chemical machining to a thickness of about one-half the thickness of the flat blank of metal.

5. A smoking pipe as recited in claim 4 wherein the flat blank of metal is formed by photo-chemical machining both sides of a piece of metal to define the perforated screen and edges of the panels.

6. A smoking pipe as recited in claim 1 wherein the unitary, flat blank of metal has a substantially uniform thickness except at the fold lines.

7. A smoking pipe as recited in claim 1, further comprising a tab attached to a stem panel, wherein the tab retains a panel of the bowl.

8. A smoking pipe as recited in claim 1, further comprising a tab attached to a panel of the bowl, wherein the tab engages a slot in the upper panel.

9. A smoking pipe as recited in claim 1 wherein the upper panel of the stem includes holes that form the perforated screen.

10. A smoking pipe comprising:

an elongated hollow stem formed of multiple flat panels enclosing a passageway having an opening at one end, the stem having an upper panel;

said upper panel having holes that form a perforated screen at an end opposite the opening of the stem, wherein the screen is open to the passageway of the stem; and a bowl formed of multiple flat panels surrounding the perforated screen;

wherein the pipe is constructed by folding a unitary, flat blank of metal, and wherein each panel is joined to at least one other adjacent panel by fold lines formed in the blank, and wherein the fold lines are areas of reduced thickness of the flat blank of metal that facilitate folding of adjacent panels and are formed by photo-chemical machining to a thickness of about one-half the thickness of the flat blank of metal.

11. A foldable blank for forming a smoking pipe, comprising:

a flat sheet of metal composed of stem panels and bowl panels, the sheet of metal having fold lines between adjacent panels, wherein the fold lines allow adjacent stem panels to be bent along the fold lines to form a hollow stem of a smoking pipe, wherein the fold lines allow adjacent bowl panels to be bent along the fold lines to form a bowl of the smoking pipe, and wherein one stem panel has holes that form a perforated screen disposed between the bowl and hollow stem of the smoking pipe.

12. A foldable blank as recited in claim 11 wherein the fold lines are areas of reduced thickness of the flat sheet of metal.

13. A foldable blank as recited in claim 11 wherein the fold lines are formed by photo-chemical machining to a thickness of about one-half the thickness of the flat sheet of metal.

14. A foldable blank as recited in claim 13 wherein the flat sheet of metal is formed by photo-chemical machining both sides of a piece of metal to define the perforated screen and outside edges of the panels.

15. A foldable blank as recited in claim 11 wherein the flat sheet of metal has a substantially uniform thickness.

* * * * *